US005583098A

United States Patent [19]

Boskamp et al.

[11] Patent Number: 5,583,098

[45] Date of Patent: Dec. 10, 1996

[54] DETERGENT COMPOSITIONS

[75] Inventors: Jelles V. Boskamp, Vlaardingen; Mark P. Houghton, Berkel en Rodenrijs; Christophe Joyeux, Rotterdam; Carolyn A. Rowe, Vlaardingen; Cornelis E. J. van Lare, Vlaardingen; Gilbert M. Verschelling, Vlaardingen; Petra Zuidgeest, Vlaardingen, all of Netherlands

[73] Assignee: Lever Brothers Company, Division of Conopco, Inc., New York, N.Y.

[21] Appl. No.: 340,969

[22] Filed: Nov. 17, 1994

[30] Foreign Application Priority Data

| | | | |
|---|---|---|---|
| Nov. 24, 1993 | [GB] | United Kingdom | 9324128 |
| Feb. 10, 1994 | [GB] | United Kingdom | 9402576 |
| Sep. 7, 1994 | [GB] | United Kingdom | 9418053 |

[51] Int. Cl.[6] ..... C11D 17/06; C11D 11/00; C11D 3/04; C11D 1/83

[52] U.S. Cl. ..... 510/351; 510/361; 510/444; 510/445; 510/507; 23/313 R

[58] Field of Search ..... 252/89.1, 135, 252/174, 174.21, 530, 531, 550; 23/313 R

[56] References Cited

U.S. PATENT DOCUMENTS

| | | | |
|---|---|---|---|
| 4,303,556 | 12/1981 | Llendado | 252/527 |
| 5,080,848 | 1/1992 | Strauss et al. | 264/117 |
| 5,238,594 | 8/1993 | Chapple | 252/95 |
| 5,409,627 | 4/1995 | Boskamp et al. | 252/102 |

FOREIGN PATENT DOCUMENTS

| | | |
|---|---|---|
| 0001853 | 5/1979 | European Pat. Off. . |
| 0265203 | 4/1988 | European Pat. Off. . |
| 0313144 | 4/1989 | European Pat. Off. . |
| 0313143 | 4/1989 | European Pat. Off. . |
| 0326208 | 8/1989 | European Pat. Off. . |
| 0349200 | 1/1990 | European Pat. Off. . |
| 0349201 | 1/1990 | European Pat. Off. . |
| 0384070 | 8/1990 | European Pat. Off. . |
| 0420317 | 4/1991 | European Pat. Off. . |
| 0425277 | 5/1991 | European Pat. Off. . |
| 0439316 | 7/1991 | European Pat. Off. . |
| 0488297 | 9/1991 | European Pat. Off. . |
| 0488298 | 9/1991 | European Pat. Off. . |
| 0456315 | 11/1991 | European Pat. Off. . |
| 0506184 | 9/1992 | European Pat. Off. . |
| 0510746 | 10/1992 | European Pat. Off. . |
| 0507402 | 10/1992 | European Pat. Off. . |
| 0513824 | 11/1992 | European Pat. Off. . |
| 0522726 | 1/1993 | European Pat. Off. . |
| 0534525 | 3/1993 | European Pat. Off. . |
| 0544492 | 6/1993 | European Pat. Off. . |
| 0578871 | 1/1994 | European Pat. Off. . |
| 2336182 | 5/1979 | Germany . |
| 2401062 | 3/1986 | Germany . |
| 3002428 | 2/1990 | Germany . |
| 1323670 | 7/1973 | United Kingdom . |
| 1325645 | 8/1973 | United Kingdom . |
| 1379734 | 1/1975 | United Kingdom . |
| 1381187 | 1/1975 | United Kingdom . |
| 1408678 | 10/1975 | United Kingdom . |
| 1429143 | 3/1976 | United Kingdom . |
| 1427071 | 3/1976 | United Kingdom . |
| 2047264 | 11/1980 | United Kingdom . |
| 2095274 | 9/1982 | United Kingdom . |
| 2041394 | 11/1982 | United Kingdom . |
| 2106482 | 4/1983 | United Kingdom . |
| WO91/15566 | 10/1991 | WIPO . |
| WO94/28109 | 12/1994 | WIPO . |
| WO94/28098 | 12/1994 | WIPO . |

*Primary Examiner*—Paul Lieberman
*Assistant Examiner*—Lorna M. Douyon
*Attorney, Agent, or Firm*—Rimma Mitelman

[57] ABSTRACT

A particulate detergent composition having a bulk density of at least 650 g/l which is not the product of a spray-drying process consists of a substantially homogeneous granular base and optional postdosed ingredients. The composition comprises a surfactant system, alkali metal aluminosilicate builder, and a water-soluble salt of citric acid, preferably sodium citrate, and optionally other ingredients. The delivery and dissolution characteristics of the composition in the wash are improved if citrate of Rosin Rammler particle size less than 800 μm is incorporated within the granular base. The composition may also contain postdosed citrate of unrestricted particle size.

12 Claims, No Drawings

DETERGENT COMPOSITIONS

TECHNICAL FIELD

The present invention relates to particulate detergent compositions of high bulk density containing organic surfactants and zeolite builder.

BACKGROUND AND PRIOR ART

There has been a recent trend in the detergents industry towards powders of high bulk density, prepared by processes that eliminate, or do not introduce, the porosity typical of traditional spray-dried powders. These include post-tower densification of spray-dried powders, and, more preferably, wholly non-tower routes involving dry-mixing, agglomeration, granulation and similar processes.

For example, EP 544 492A (Unilever) discloses high bulk density powders containing a high level of high performance surfactants (ethoxylated nonionic surfactant plus primary alcohol sulphate), zoolite builder, and other optional ingredients. The use of relatively high levels of zoolite allows the formulation of free-flowing powders containing high levels of these mobile surfactants.

These compositions consist essentially of a dense granular base containing surfactants, zeolite, sodium carbonate, soap and other minor ingredients, prepared preferably by a wholly non-tower mixing and granulation process, for example, in a high-speed mixer/granulator which combines high speed stirring and cutting actions.

To the base powder are admixed (postdosed) further ingredients which may be unsuitable for incorporation in the base powder for various reasons, for example, bleaching persalts, bleach precursors and bleach stabilisers, enzyme granules, foam control granules, and perfume.

With formulations of this type, some problems have been experienced in the delivery of the active ingredients of the powder to the wash in an automatic washing machine. Delivery is a two-step process: the first step is the dispensing of the powder into the wash liquor, either from the dispenser drawer of the washing machine or from a dispensing device (a wash ball or similar) supplied by the powder manufacturer; and the second is dissolution of the powder once it arrives in the wash water.

It has surprisingly been found that in high bulk density powder of the type mentioned above, delivery is improved by incorporating a citric acid salt of small particle size in the dense granular base powder. If desired, additional citrate (not necessarily of same particle size) may be postdosed.

Citrates are well known as detergency builders used to supplement zeolites. Their use in zeolite-built powders is disclosed, for example, in EP 313 143A, EP 313 144A, EP 448 297A and EP 448 298A (Unilever); GB 1 408 678, EP 1310A, EP 1853B, EP 326 208A, EP 456 315A and WO 91 15566A (Procter & Gamble); DE 2 336 182C (Lion); and GB 2 095 274B (Colgate). The art discloses the incorporation of sodium citrate in conventional porous spray-dried base powders, and also discloses the postdosing of sodium citrate.

High bulk density detergent powders containing sodium citrate are disclosed in our copending International Patent Application No. PCT/EP94/01291 filed on 26 Apr. 1994, but the sodium citrate is postdosed as a relatively coarse material (typical average particle size above 800 μm).

EP 425 277A (Unilever) discloses detergent powders of high bulk density prepared by densifying a spray-dried base powder. The powders contain soap, nonionic surfactant, zeolite and sodium citrate.

EP 349 201A (Procter & Gamble) describes the preparation of a compact detergent powder by a process in which an aqueous surfactant paste is mixed with dry detergent builders to form a dough, and the dough is then chilled and granulated by fine dispersion mixing to form particles. Compositions containing zeolite and high levels of sodium citrate (typically 17–27 wt %) are disclosed.

The incorporation of citrate of defined particle size in a non-spray-dried base to improve the delivery and dissolution of a high bulk density detergent powder has not been described in the literature.

DEFINITION OF THE INVENTION

The present invention accordingly provides a particulate detergent composition having a bulk density of at least 650 g/l which is not the product of a spray-drying process, the composition consisting of a substantially homogeneous granular base and optionally postdosed ingredients, the composition comprising (a) from 15 to 50 wt % of an organic surfactant system,
(b) from 20 to 70 wt % (anhydrous basis) of alkali metal aluminosilicate builder,
(c) from 0.5 to 40 wt % of a water-soluble salt of citric acid,
(d) optionally other detergent ingredients to 100 wt %, wherein at least 0.5 wt % (based on the total composition) of the citric acid salt (c) is within the substantially homogeneous granular base, and all the citric acid salt (c) that is within the substantially homogeneous granular base has a Rosin Rammler particle size of less than 800 μm..

The invention further provides a process for the preparation of a particulate detergent composition having a bulk density of at least 650 g/l, which comprises mixing and granulating surfactants, alkali metal aluminosilicate builder, a water-soluble salt of citric acid and optionally other detergent ingredients to form a substantially homogeneous granular base, and optionally postdosing further detergent ingredients, to form a final composition defined as in the previous paragraph.

The invention further provides the use of a citric acid salt having a Rosin Rammler particle size not exceeding 800 μm to improve the dissolution properties of a particulate detergent composition as defined above, the citric acid salt being incorporated in an amount of at least 0.5 wt % (based on the whole product) in the substantially homogeneous granular base.

DETAILED DESCRIPTION OF THE INVENTION

The high bulk density particulate detergent composition of the invention consists essentially of a dense granular base (hereinafter the base powder), and optional postdosed ingredients. The composition contains as essential ingredients:

(a) a surfactant system,
(b) an aluminosilicate builder,
(c) a citric acid salt, at least part of which is incorporated in the base powder.

Other optional ingredients may be present as necessary or desired, either in the base powder or postdosed.

The compositions are made by mixing and granulation processes that do not involve spray-drying.

The compositions of the invention are characteristically of low particle porosity. Preferably the particles have a void volume not exceeding 10%, more preferably not exceeding 5%, and desirably as low as possible. Void volume may be measured by mercury porosimetry.

The Surfactant System

The compositions of the invention contain from 15 to 50 wt %, preferably from 15 to 30 wt %, of an organic surfactant system.

The surfactant(s) constituting the organic surfactant system may be chosen from the many suitable detergent-active compounds available. These are fully described in the literature, for example, in "Surface-Active Agents and Detergents", Volumes I and II, by Schwartz, Perry and Berch.

Anionic surfactants are well-known to those skilled in the art. Examples include alkylbenzene sulphonates, particularly linear alkylbenzene sulphonates having an alkyl chain length of $C_8$–$C_{15}$; primary and secondary alkyl sulphates, particularly $C_8$–$C_{24}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Nonethoxylated nonionic surfactants include alkylpolyglycosides, glycerol monoethers, and polyhydroxyamides (glucamide).

Preferred compositions of the invention contain at least 5 wt %, more preferably at least 10 wt %, of an ethoxylated nonionic surfactant.

Preferably the ethoxylated alcohol nonionic surfactant has an average alkyl chain length of $C_8$–$C_{18}$, preferably $C_{12}$–$C_{16}$, and an average degree of ethoxylation within the range of from 2.5 to 8.0, preferably from 4.0 to 8.0, more preferably from 5.2 to 8.0.

Advantageously, the nonionic surfactant, whether of vegetable or petrochemical origin, is predominantly or wholly linear. Especially preferred are nonionic surfactants derived from coconut oil. However, synthetic materials containing some branched material are also within the scope of the invention.

A preferred surfactant system for use in the compositions of the invention comprises ethoxylated nonionic surfactant in combination with primary alcohol sulphate (PAS). In this embodiment, the ethoxylated nonionic surfactant preferably constitutes from 30 to 90 wt % of the surfactant system, more preferably from 40 to 70 wt %; and the PAS preferably constitutes from 10 to 70 wt %, more preferably from 30 to 60 wt %, of the surfactant system. Preferably the whole composition contains at least 5 wt % of PAS.

The PAS suitably has a chain length in the $C_8$–$C_{18}$ range, preferably $C_{12}$–$C_{16}$. If desired, mixtures of chain lengths may be used as described and claimed in EP 342 917A (Unilever).

Wholly or predominantly linear PAS is preferred. PAS of vegetable origin, and more especially PAS from coconut oil (cocoPAS), is especially preferred. However, branched PAS as described and claimed in EP 439 316A (Unilever) may also be used. The PAS is preferably present in sodium salt form.

Other anionic surfactants may be present, but it is preferred that the surfactant system contain no more than 25 wt %, preferably no more than 5 wt %, of alkylbenzene sulphonates. These materials appear to have a detrimental effect on delivery and dissolution.

The compositions of the invention may also advantageously contain fatty acid soap, suitably in an amount of from 1 to 5 wt %. However, the soap functions primarily as a powder structurant, giving crisp free-flowing powder, rather than as a surfactant.

The Aluminosilicate Builder

The detergent compositions of the invention contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula:

$$0.8\text{–}1.5\ Na_2O.\ Al_2O_3.\ 0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, more preferably not exceeding 1.07; preferably from 0.90 to 1.33, more preferably 0.90 to 1.20, and most preferably from 0.90 to 1.07.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Preferred zeolite MAP for use in the present invention is especially finely divided and has a $d_{50}$ (as defined below) within the range of from 0.1 to 5.0 μm, more preferably from 0.4 to 2.0 μm and most preferably from 0.4 to 1.0 μm. The quantity "$d_{50}$" indicates that 50 wt % of the particles have a diameter smaller than that figure.

The Citric Acid Salt

The compositions of the invention also contain as an essential ingredient a water-soluble salt of citric acid, preferably sodium citrate. The total amount of citric acid salt present ranges from 0.5 to 40 wt %, preferably from 1 to 40 wt %, more preferably from 1 to 30 wt %.

It is an essential feature of the invention that at least part of any citrate present be incorporated in the base powder. The citrate in the base powder should amount to at least 0.5 wt %, preferably at least 1 wt % and suitably from 1 to 15 wt %, of the total composition.

In preferred compositions containing a total of from 1 to 40 wt % of citric acid salt, at least 1 wt % should be present in the base powder. In compositions containing from 5 to 40 wt % in total of citric acid salt, at least 3 wt % of citric acid salt, preferably from 3 to 15 wt %, should desirably be present in the base powder. However, lower amounts, for example, from 1 to 5 wt %, have also been found to be effective.

The compositions of the invention may also contain postdosed citrate if desired. The amount of postdosed citrate may suitably range from 5 to 25 wt %.

It is essential that all of the citric acid salt that is in the base powder should have a Rosin Rammler particle size of less than 800 μm, preferably not exceeding 500 μm, and more preferably within the range of from 100 to 500 μm. Suitable commercially available materials may, for example, have Rosin Rammler particle sizes of <150, 377 or 415 μm.

This is in contrast to postdosed citrate which will generally have a larger Rosin Rammler particle size, comparable with that of the base powder, for example, 834 μm.

Where the citrate salt is sodium citrate, all percentages refer to the dihydrate.

Other Builders

Other builders may also be included in the detergent compositions of the invention as necessary or desired. For example, polycarboxylate polymers, more especially polyacrylates and acrylic/maleic copolymers, may suitably be used in amounts of from 0.5 to 15 wt %, especially from 1 to 10 wt %.

Other Ingredients

The compositions in accordance with the invention may contain sodium carbonate, to increase detergency and to ease processing. Sodium carbonate may generally be present in amounts ranging from 1 to 60 wt %, preferably from 2 to 40 wt %, and most suitably from 2 to 13 wt %. However, compositions free of alkali metal carbonate are also within the scope of the invention.

As previously indicated, the compositions also advantageously contain fatty acid soap, as a powder structurant, suitably in an amount of from 1 to 5 wt %.

Other ingredients which may be present in the base powder include fluorescer; sodium silicate; and antiredeposition agents such as cellulosic polymers, for example, sodium carboxymethyl cellulose. Optional ingredients that may generally be admixed (postdosed) to give a final product include bleach components such as sodium perborate or percarbonate, bleach activators and bleach stabilisers; sodium carbonate; proteolytic and lipolytic enzymes; dyes; foam control granules; coloured speckles; perfumes; and fabric softening compounds. This list is not intended to be exhaustive.

Preparation of the Detergent Compositions

As previously indicated, the compositions of the invention are of high bulk density and are prepared by non-tower (non-spray-drying) processes in which solid and liquid ingredients are mixed and granulated together to produce a base powder, to which other ingredients may subsequently be postdosed if desired. Such powders have relatively non-porous particles and may be especially prone to delivery, dispersion and dissolution problems in use.

To prepare the compositions of the invention, a citric acid salt, preferably sodium citrate dihydrate, is included in the mixing and granulation process, in an amount of at least 0.5 wt %, preferably from 1 to 15 wt %, of the final composition. The citric acid salt to be incorporated in the base powder has a Rosin Rammler particle size of less than 800 μm, preferably not exceeding 500 μm, and more preferably from 100 to 500 μm.

The mixing and granulation process is preferably carried out in such a way that discrete granules or particles are present throughout, that is to say, at no stage is a dough or paste formed. The composition thus remains in the form of discrete granules thoughout the granulation step, and the process does not involve the formation and subsequent break-up of a dough.

According to an especially preferred process, the preparation of the base powder is carried out in a high-speed mixer/granulator having both a stirring and a cutting action. The high-speed mixer/granulator, also known as a high-speed mixer/densifier, may be a batch machine such as the Fukae (Trade Mark) FS, or a continuous machine such as the Lödige (Trade Mark) Recycler CB30.

Suitable processes are described, for example, in EP 544 492A, EP 420 317A and EP 506 184A (Unilever).

Generally the inorganic builders and other inorganic materials (for example, zeolite, sodium carbonate) are granulated with the surfactants, which act as binders and granulating or agglomerating agents. The citric acid salt is incorporated at this stage. Fatty acid soap may be prepared by in situ neutralisation with sodium hydroxide solution during the mixing and granulation process.

The citric acid salt may be incorporated in the form of a powder or granule. Alternatively, it may be incorporated in the form of an intimate mixture with surfactant, more preferably nonionic surfactant. Fatty acid may also be added in the form of a premix with surfactant, again preferably nonionic surfactant.

The mixing and granulation process is preferably carried out at a temperature of at least 25° C.

Any optional ingredients as previously mentioned may be incorporated at any suitable stage in the process.

As previously mentioned, preferred compositions of the invention contain PAS and ethoxylated nonionic surfactant. The PAS present may be already neutralised, that is to say in salt form, when dosed into the high-speed mixer/granulator, or alternatively may be added in acid form and neutralised in situ. If desired, PAS and nonionic surfactant may be introduced in the form of a homogeneous liquid blend, as described in EP 265 203A and EP 507 402A (Unilever).

EP 420 317A and EP 506 184A (Unilever) disclose a different process wherein PAS acid, which is a liquid, is mixed and reacted with a solid inorganic alkaline material, such as sodium carbonate, in a continuous high-speed mixer. The resulting granule or "adjunct" is then dosed into another high-speed mixer with the nonionic surfactants and solid ingredients. All these processes are suitable for the preparation of compositions of the invention.

In accordance with normal detergent powder manufacturing practice, bleach ingredients (bleaches, bleach precursor, bleach stabilisers), proteolytic and lipolytic enzymes, coloured speckles, perfumes and foam control granules are most suitably postdosed to the base powder after it has left the high-speed mixer/granulator.

Additional citrate may if desired be among the postdosed ingredients. As previously indicated, this will generally be of larger particle size than the citrate incorporated in the base powder.

Powder Properties

The particulate detergent compositions of the invention have bulk densities of at least 650 g/l, preferably at least 770 g/l, and more preferably at least 800 g/l.

As indicated previously, powder porosity is typically low: preferably, the void volume does not exceed 10%, and more preferably it does not exceed 5%. Such low values are not exhibited by powders which are the direct products of spray-drying processes.

Advantageously, the content of "fines", that is to say, particles smaller than 180 μm, does not exceed 10 wt %, and more preferably it does not exceed 5 wt %.

EXAMPLES

The invention is further illustrated by the following non-limiting Examples, in which parts and percentages are by weight unless otherwise stated.

Examples 1 to 4, Comparative Examples A and B

Detergent powders of high bulk density were prepared to the formulations shown in Tables 1 and 2.

Base powders were prepared using a continuous high-speed mixer/granulator, and other ingredients were postdosed as shown. Sodium citrate dihydrate having a Rosin Rammler particle size of 150 μm was incorporated by dosing directly into the high-speed mixer/granulator.

The composition remained in the form of discrete granules throughout processing in the high-speed mixer/granulator.

The postdosed sodium citrate dihydrate had a Rosin Rammler particle size of 834 μm.

Examples 1 to 4 (Table 1) were in accordance with the invention. All contained citrate in the base; Examples 1 and 2 also contained postdosed citrate.

Comparative Example A was a control formulation without citrate but with the same (other) postdosed ingredients.

Comparative Example B contained a high level of postdosed citrate but none in the base.

Delivery into the wash, dispersion and dissolution characteristics were assessed by means of three different tests.

Test 1: Cage Test

Delivery characteristics of the powders were compared using a model system which simulates the delivery of a powder in an automatic washing machine, under more adverse conditions (low temperature, minimal agitation) than those normally encountered in a real wash situation.

For this test a cylindrical vessel having a diameter of 4 cm and a height of 7 cm, made of 600 micrometer pore size stainless steel mesh, and having a top closure made of Teflon and a bottom closure of the mesh just described, was used. The top closure had inserted therein a 30 cm metal rod to act as a handle, and this handle was attached to an agitator arm positioned above 1 liter of water at 20° C. in an open container. By means of this agitator apparatus the cylindrical vessel, held at 45 degrees, could be rotated through a circle with a 10 cm radius over a period of 2 seconds and allowed to rest for 2 seconds, before the start of the next rotation/rest cycle.

A 50 g powder sample was introduced into the cylindrical vessel which was then closed. The vessel was attached to the agitator arm which was then moved down to a position such that the top of the cylindrical vessel was just below the surface of the water. After a 10 second delay, the apparatus was operated for 15 rotation/rest cycles.

The cylindrical vessel and handle were removed from the water and and the vessel detached from the handle. Surface water was carefully poured off, and any powder residues transferred to a preweighed container and dried for 24 hours at 100° C. The weight of dried residue as a percentage of the initial powder weight (50 g) was then calculated.

Test 2: Delivery Device Test

Delivery characteristics of the powders were also compared using a model system which emulates the delivery of a powder in an automatic washing machine from a flexible delivery device of the type supplied with Lever's Persil (Trade Mark) Micro System powder in the UK: a spherical container of flexible plastics material having a diameter of approximately 4 cm and a top opening of diameter approximately 3 cm.

In this test the delivery device was attached in an upright position (opening uppermost) to an agitator arm positioned above water. By means of this apparatus the device could be moved vertically up and down through a distance of 30 cm, the lowest 5 cm of this travel being under water. Each up or down journey had a duration of 2 seconds, the device being allowed to rest 5 cm under water for 4 seconds at the lowest position, and at the highest position being rotated through 100° and allowed to rest in the resulting tilted orientation for 2 seconds before redescending. 5 liters of water at a temperature of 20° C. were used.

A preweighed powder sample was introduced into the device in its highest position, and the apparatus then allowed to operate for six cycles and stopped when the device was again in its highest position. Surface water was carefully poured off, and any powder residues transferred to a preweighed container. The container was then dried at 100° C. for 24 hours, and the weight of dried residue as a percentage of the initial powder weight calculated.

Test 3; Black Pillowcase Test

A washing machine test was also used to determine the extent that insoluble residues were deposited on washed articles. The machine used was a Siemens Siwamat (Trade Mark) Plus 3700 front-loading automatic washer.

A 100 g dose of powder was placed in a flexible delivery device as described previously. The delivery device was placed inside a black cotton pillowcase having dimensions of 30 cm by 60 cm, taking care to keep it upright, and the pillowcase was then closed by means of a zip fastener. The pillowcase containing the (upright) delivery device was then placed on top of a 3.5 kg dry cotton washload in the drum of the washing machine.

The machine was operated on the "heavy duty cycle" at a wash temperature of 40° C., using water of 15° French hardness and an inlet temperature of 20° C. At the end of the wash cycle the pillowcase was removed, opened and turned inside out, and the level of powder residues on its inside surfaces determined by visual assessment using a scoring system of 1 to 5: a score of 5 corresponds to a residue of approximately 75 wt % of the powder, while 1 indicates no residue. A panel of five assessors was used to judge each pillowcase and allot a score. With each powder the wash process was carried out ten times and the scores were averaged over the ten repeats.

Table 3 shows the powder properties and delivery characteristics of the powders. The delivery and dissolution benefits of including citrate in the base are clear.

TABLE 1

| Example | 1 | 2 | 3 | 4 |
|---|---|---|---|---|
| formulations of the invention | | | | |
| Base | | | | |
| CocoPAS | 14.68 | 14.70 | 18.82 | 18.82 |
| Nonionic 7EO | 3.22 | 3.22 | 4.12 | 4.12 |
| Nonionic 3EO | 4.07 | 4.08 | 5.22 | 5.22 |
| Zeolite MAP | 16.29 | 19.85 | 20.88 | 25.42 |
| Sodium carbonate | 2.57 | 2.57 | 3.30 | 3.30 |
| Sodium citrate | 7.98 | 4.02 | 10.24 | 5.15 |
| SCMC | 0.54 | 0.54 | 0.69 | 0.69 |
| Moisture | 4.23 | 4.61 | 5.43 | 5.91 |
| Total | 53.58 | 53.58 | 68.70 | 68.70 |
| Postdosed | | | | |
| Sodium citrate 2aq | 15.12 | 15.12 | — | — |
| Sodium percarbonate | 16.85 | 16.85 | 16.85 | 16.85 |
| TAED granules | 3.75 | 3.75 | 3.75 | 3.75 |
| Catalyst granules | 1.27 | 1.27 | 1.27 | 1.27 |
| Sodium silicate | 3.67 | 3.67 | 3.67 | 3.67 |
| Antifoam/fluorescer | 3.00 | 3.00 | 3.00 | 3.00 |
| EDTMP (Dequest 2047) | 0.37 | 0.37 | 0.37 | 0.37 |
| Enzymes | 1.75 | 1.75 | 1.75 | 1.75 |
| Perfume | 0.65 | 0.65 | 0.65 | 0.65 |
| | 100.00 | 100.00 | 100.00 | 100.00 |

TABLE 2

| Comparative Example | A | B |
|---|---|---|
| comparative formulations | | |
| Base | | |
| CocoPAS | 6.79 | 6.92 |
| Nonionic 7EO | 6.69 | 6.82 |
| Nonionic 3EO | 8.49 | 8.65 |
| Zeolite MAP | 36.47 | 37.16 |
| Sodium carbonate | 1.19 | 1.21 |
| Fatty acid soap | 2.25 | 2.30 |
| Sodium citrate | — | — |
| SCMC | 0.68 | 0.69 |
| Moisture | 6.13 | 6.25 |
| Total | 68.69 | 70.00 |
| Postdosed | | |
| Sodium citrate (2 aq) | — | 23.62 |
| Sodium percarbonate | 16.85 | — |
| TAED granules | 3.75 | — |
| Catalyst granules | 1.27 | — |
| Sodium silicate | 3.67 | — |
| Antifoam/fluorescer | 3.00 | 3.00 |
| EDTMP (Dequest 2047) | 0.37 | 1.43 |
| Enzymes | 1.75 | 1.63 |
| Perfume | 0.65 | 0.45 |
| | 100.00 | 100.13 |

TABLE 3

| Example | A | B | 1 | 2 | 3 | 4 |
|---|---|---|---|---|---|---|
| properties | | | | | | |
| Powder properties | | | | | | |
| Bulk density (g/l) | 890 | 900 | 870 | 880 | 890 | 880 |
| Average particle size (μm) | 570 | 580 | 565 | 590 | 590 | 575 |
| wt % fines | 5.5 | 3.0 | 2.3 | 4.5 | 4.0 | 3.8 |

TABLE 3-continued

| Example | A | B | 1 | 2 | 3 | 4 |
|---|---|---|---|---|---|---|
| properties | | | | | | |
| Delivery properties | | | | | | |
| Test 1 (wt % residue) | 58 | 65 | 33 | 37 | 18 | 23 |
| Test 2 (wt % residue) | 11 | 12 | 0 | 0 | 0 | 0 |
| Test 3 (score 1–5) | 1.0 | 1.8 | 0.3 | 0.2 | 0.4 | 0.5 |

Examples 5 and 6

These Examples describe the preparation of detergent powders according to the present invention using an intimate mixture of citrate and nonionic surfactant.

A detergent base powder was prepared to the following formulation, and ingredients postdosed to prepare two fully formulated products, Examples 5 and 6.

| | Base | Example 5 | Example 6 |
|---|---|---|---|
| CocoPAS | 9.2 | 5.95 | 6.44 |
| Nonionic 6.5EO | 9.1 | 5.89 | 6.37 |
| Nonionic 3EO | 11.2 | 7.24 | 7.84 |
| Zeolite MAP | 56.3 | 36.41 | 39.41 |
| Sodium carbonate | 1.8 | 1.16 | 1.26 |
| Soap | 3.3 | 2.13 | 2.31 |
| Sodium citrate | 7.4 | 4.79 | 5.18 |
| Moisture, salts | 1.7 | 1.10 | 1.19 |
| Total base | 100.0 | 64.68 | 70.00 |
| Postdosed | | | |
| Coated percarbonate | | 20.50 | — |
| TAED granules (83%) | | 4.75 | — |
| Mn catalyst granules | | 2.40 | — |
| EDTMP (Dequest 2047) | | 0.37 | 1.43 |
| Sodium disilicate (80%) | | 2.10 | — |
| Sodium citrate (2aq) | | — | 23.47 |
| Antifoam/fluorescer | | 3.00 | — |
| Antifoam/PVP | | — | 3.15 |
| Enzymes | | 1.75 | 1.50 |
| Perfume | | 0.45 | 0.45 |

The sodium citrate incorporated in the base was finely divided, having a Rosin Rammler particle diameter of 377 μm (n=2.53). The citrate was premixed with 6.5 EO nonionic surfactant (45 wt % citrate, 55 wt % nonionic surfactant) to form a dispersion which was maintained at about 50° C. with continuous stirring.

The base powder was prepared by a continuous process using a high-speed mixer/granulator, the Lödige (Trade Mark) CB30 Recycler. The following ingredients were fed into the Recycler:

Zeolite MAP

PAS/zeolite MAP/sodium carbonate adjunct

Premix of sodium citrate (45 wt %) and 6.5 EO nonionic surfactant (55 wt %)

Premix of fatty acid (20.19 wt %) and 3 EO surfactant (79.81 wt %)

Sodium hydroxide solution

After mixing and granulation, the product passed to a Lödige (Trade Mark) KM300 Ploughshare medium speed mixer/granulator, and was then dried on a fluid bed and sieved to remove particles larger than 1500 μm and smaller than 250 μm.

The base had a Rosin Rammler particle size of 653 μm (n=2.96).

Ingredients were postdosed, as indicated in the previous table, to give a bleaching formulation (Example 5) and a non-bleaching formulation (Example 6). Properties are given in the table that follows.

| | Example 5 | Example 6 |
|---|---|---|
| Powder properties | | |
| Bulk density (g/l) | 855 | 903 |
| Average particle size (μm) | 666 | 594 |
| Dynamic flow rate (ml/s) | 162 | 154 |
| wt % fines | 3.3 | 3.1 |
| Delivery properties | | |
| Test 1 (wt % residue) | 23.7 | 30.8 |
| Test 2 (wt % residue) | 0 | 0 |

Examples 7 and 8, Comparative Examples C and D

This experiment compared two powders according to the present invention (Examples 7 and 8), containing finely divided sodium citrate in the base, with a powder outside the invention (Comparative Example C) containing the same amount of larger-particle-size citrate in the base, and a control (Comparative Example D) containing no citrate. The amount of sodium citrate in Examples 7, 8 and C was 6 wt % of the base powder, or 3.73 wt % of the whole product.

Detergent base powders were prepared to the following formulations, and ingredients postdosed to prepare four fully formulated products. Sodium citrate particle sizes quoted are Rosin Rammler diameters.

| | 7 | 8 | C | D |
|---|---|---|---|---|
| CocoPAS | 5.40 | 5.40 | 5.40 | 5.54 |
| Nonionic 7EO | 7.80 | 7.80 | 7.80 | 7.53 |
| Nonionic 3EO | 5.20 | 5.20 | 5.20 | 5.01 |
| Zeolite MAP | 35.56 | 35.56 | 35.56 | 38.35 |
| Sodium carbonate | 1.08 | 1.08 | 1.08 | 1.10 |
| Soap | 1.92 | 1.92 | 1.92 | 1.95 |
| Soduim citrate <150 μm | 3.73 | — | — | — |
| Sodium citrate 415 μm | — | 3.73 | — | — |
| Sodium citrate 824 μm | — | — | 3.73 | — |
| Moisture, salts to | 62.11 | 62.11 | 62.11 | 62.11 |
| Postdosed | | | | |
| Antifoam/fluorescer | 3.50 | 3.50 | 3.50 | 3.50 |
| Sodium carbonate | 2.03 | 2.03 | 2.03 | 2.03 |
| Sodium percarbonate | 20.50 | 20.50 | 20.50 | 20.50 |
| TAED granules | 9.25 | 9.25 | 9.25 | 9.25 |
| Enzymes | 1.42 | 1.42 | 1.42 | 1.42 |
| Minor ingredients to | 100 | 100 | 100 | 100 |

The base powders were prepared by a continuous process using a high-speed mixer/granulator, the Lödige (Trade Mark) CB30 Recycler. The following ingredients were fed into the Recycler:

Zeotite MAP

PAS/zeolite MAP/sodium carbonate adjunct

Premix of fatty acid and nonionic surfactant

Sodium hydroxide solution

Sodium citrate dihydrate powder of the relevant particle size (except Comparative Example D);

Nonionic surfactants

After mixing and granulation, the base powders passed to a Lödige (Trade Mark) KM300 Ploughshare medium speed mixer/granulator, and were then cooled in a fluid bed and sieved to remove particles larger than 1500 μm and smaller than 250 μm. Ingredients were postdosed, as indicated in the previous table, to give full formulations.

Properties of the base powders are given in the table that follows.

| Powder properties | 7 | 8 | C | D |
|---|---|---|---|---|
| Bulk density (g/l) | 830 | 848 | 853 | 880 |
| Average particle size (μm) | 871 | 637 | 854 | 600 |
| Dynamic flow rate (ml/s) | 161 | 150 | 160 | 150 |
| wt % fines | 0.7 | 7.6 | 1.5 | 5.0 |

Delivery Properties

A different washing machine test from that used in previous Examples was used to determine the extent that residues were deposited on washed articles. The following washing conditions were used:

Machine: Siemens Siwamat (Trade Mark) 3803 front-loading automatic washer

Temperature: 40° C. woolwash cycle with water intake at 20° C.

Water: Tap water, 15° (French) hardness

Load: 1 kg clean load

The test methodology was as follows. 10 g doses of powder were placed inside sachets of reactive black cotton (135 g/m$^2$) with satin bindings, having dimensions of 10 cm by 10 cm, which were then closed by stapling. For each wash, up to ten such sachets were pinned to a bathtowel which formed part of the washload. At the end of the wash cycle the sachets were removed, opened and dried for at least 15 minutes on top of a dry bathtowel. A panel of three assessors then assigned scores to the levels of powder residues remaining on the internal surface of the sachets by visual comparison with a set of standard control samples, according to the following scoring system:

| | |
|---|---|
| No residues | 0 |
| Very slight residues (isolated specks) | 0.5 |
| Slight residues (small clumps) | 1.0 |
| Low residues (larger clumps) | 1.5 |
| Moderate residues | 2.0 |
| Significant residues | 2.5 |
| High residues | 3.0 |
| Very high residues | >3.0 |

A score of 1.5 is considered to represent the upper limit of acceptability.

For each powder sample six sachets were used and washed in three separate runs. The scores were averaged over the six repeats. The results were as follows:

| | 7 | 8 | C | D |
|---|---|---|---|---|
| Residue score | 0.6 | 0.5 | 1.0 | 1.5 |

These results show the critical effect of citrate particle size on the dissolution characteristics.

Examples 9 and 10

Together with Example 8, these results show that lower amounts of citrate can also give good results.

Base powders were prepared to the general formulation given in Example 8, but with differing amounts of citrate having a Rosin Rammler diameter of 415 μm (the proportions of other ingredients remaining the same). The fully formulated powders were subjected to the washing machine test described above and the results were as follows:

| | 8 | 9 | 10 |
|---|---|---|---|
| Sodium citrate of 415 μm | | | |
| (wt % of base powder) | 6 | 4 | 2 |
| (wt % of whole product) | 3.73 | 2.48 | 1.24 |
| Residue scores | 0.5 | 0.5 | 0.5 |

These results show that lower amounts of small-particle-size citrate in the base also show excellent dissolution behaviour.

We claim:

1. A particulate detergent composition having a bulk density of at least 650 g/l which is not the product of a spray-drying process the composition having a homogeneous granular base and postdosed ingredients, the composition comprising (a) from 15 to 50 wt % of an organic surfactant system wherein the organic surfactant system contains at least 5 wt %, based on the whole composition, of ethoxylated nonionic surfactant and contains at least 5 wt %, based on the whole composition, of primary alcohol sulphate, (b) from 20 to 70 wt %, based on the anhydrous material, of alkali metal aluminosilicate builder, (c) from 1 to 40 wt % of a water-soluble salt of citric acid, (d) other detergent ingredients to 100 wt %, selected from the group consisting of fatty acid soaps, detergency builders other than aluminosilicate and citrate, sodium carbonate, sodium silicate, fluorescers, antiredeposition agents, bleach compounds, bleach activators, bleach stabilizers, enzymes, dyes, foam control granules, colored speckles, perfumes and fabric softening compounds, wherein the homogeneous granular base comprises at least the organic surfactant system (a), the alkali metal aluminosilicate builder (b), and from, 1 to 15 wt %, based on the total composition, of the citric acid salt and all of the citric acid salt (c) that is within the homogeneous granular base has a Rosin Rammler particle size within the range of from 100 to 500 μm, and wherein the postdosed ingredients comprise 0 to 25 wt %, based on the total composition, of the citric acid salt (c), and further postdosed ingredients selected from the group consisting of sodium carbonate, bleach compounds, bleach activators, bleach stabilizers, enzymes, dyes, foam control granules, colored speckles, perfumes and fabric softening compounds.

2. A detergent composition as claimed in claim 1, wherein it comprises from 5 to 40 wt % of the citric acid salt (c), and in that the amount of the citric acid salt in the homogeneous granular base, all of which has a Rosin Rammler particle size within the range of from 100 to 500 μm, is at least 3 wt % based on the total composition.

3. A detergent composition as claimed in claim 1, wherein the citric acid salt (c) is sodium citrate dihydrate.

4. A detergent composition as claimed in claim 1, wherein the amount of the citric acid salt (c) incorporated in the granular base is from 1 to 5 wt % based on the total composition.

5. A detergent composition as claimed in claim 1, wherein the alkali metal aluminosilicate (b) is zeolite MAP having a silicon to aluminum ratio not exceeding 1.33.

6. A detergent composition as claimed in claim 1, wherein the organic surfactant system (a) consists essentially of:

(i) ethoxylated nonionic surfactant which is a primary $C_8$–$C_{18}$ alcohol having an average degree of ethoxylation within the range of from 2.5 to 8.0, and (ii) primary alcohol sulphate.

7. A detergent composition as claimed in claim 1, having a bulk density of at least 770 g/l.

8. A process for the preparation of a particulate detergent composition having a bulk density of at least 650 g/l, which comprises mixing and granulating surfactants, alkali metal aluminosilicate builder, a water-soluble salt of citric acid and other detergent ingredients to form a homogeneous granular base, and postdosing further detergent ingredients, to form a final composition comprising:

(a) from 15 to 50 wt % of an organic surfactant system, wherein the organic surfactant system contains at least 5 wt %, based on the whole composition, of ethoxylated nonionic surfactant and contains at least 5 wt %, based on the whole composition, of primary alcohol sulphate, (b) from 20 to 70 wt %, based on the anhydrous material, of alkali metal aluminosilicate builder, (c) from 1 to 40 wt % of a water-soluble salt of citric acid, (d) other detergent ingredients to 100 wt %, selected from the group consisting of fatty acid soaps, detergency builders other than aluminosilicate and citrate, sodium carbonate, sodium silicate, fluorescers, antiredeposition agents, bleach compounds, bleach activators, bleach stabilizers, enzymes, dyes, foam control granules, colored speckles, perfumes and fabric softening compounds wherein the homogeneous granular base comprises at least the organic surfactant system (a), the alkali metal aluminosilicate builder (b), and from 1 to 15 wt %, based on the total composition, of the citric acid salt (c), and all of the citric acid salt (c) that is within the homogeneous granular base has a Rosin Rammler particle size within the range of from 100 to 500 μm, and wherein the postdosed ingredients comprise 0 to 25 wt %, based on the total composition, of the citric acid salt (c), and further postdosed ingredients selected from the group consisting of sodium carbonate, bleach compounds, bleach activators, bleach stabilizers, enzymes, dyes, foam control granules, colored speckles, perfumes and fabric softening compounds.

9. A process as claimed in claim 8, wherein discrete particles are present throughout the mixing and granulation process.

10. A process as claimed in claim 8, wherein the mixing and granulation process for preparation of the homogeneous granular base is carried out at a temperature of at least 25° C.

11. A process as claimed in claim 8, wherein the citric acid salt (c) is incorporated within the granular base as an intimate mixture with ethoxylated nonionic surfactant.

12. A process as claimed in claim 8, wherein the mixing and granulation process for the preparation of the homogeneous granular base are carried out in a high-speed mixer/granulator having both a stirring action and a cutting action.

* * * * *